US005411637A

United States Patent [19]

Glomb et al.

[11] Patent Number: 5,411,637

[45] Date of Patent: May 2, 1995

[54] METHOD FOR PRODUCING HIGH PRESSURE LAMINATES

[75] Inventors: John W. Glomb, Wilton, Conn.; Yvette A. Tramount, Charleston, S.C.

[73] Assignee: Westvaco Corporation, New York, N.Y.

[21] Appl. No.: 157,973

[22] Filed: Nov. 24, 1993

Related U.S. Application Data

[63] Continuation-in-part of Ser. No. 52,456, Apr. 26, 1993, abandoned, which is a continuation-in-part of Ser. No. 887,697, May 22, 1992, abandoned.

[51] Int. Cl.[6] ..... D21H 19/10

[52] U.S. Cl. ..... 162/135; 162/123; 162/127; 162/175; 162/184; 162/186; 156/307.4; 156/307.5; 156/307.7; 428/533

[58] Field of Search ..... 162/135, 184, 175, 141, 162/123, 127, 186; 428/533, 535; 156/307.3, 307.4, 307.5, 307.7, 318

[56] References Cited

U.S. PATENT DOCUMENTS 2,503,407 4/1950 Perry .
3,210,240 10/1965 Read et al. .
3,639,209 2/1972 Buckman et al. .
3,859,108 1/1975 Ware et al. .
4,060,450 11/1977 Palazzolo et al. .

FOREIGN PATENT DOCUMENTS 704036 2/1965 Canada ..... 162/186
848397 8/1970 Canada .
1601282 10/1981 United Kingdom .

OTHER PUBLICATIONS

Richard F. Burtt, "Reduction of Offset Printing Rejects," *TAPPI*, vol. 50, No. 11 (Nov. 1967), pp. 135A–137 A.

Merhcant L. Cushing, "Surface Sizing," *Pulp and Paper Chemistry and Chemical Technology* 3rd Edition, vol. III, Chapter 20, pp. 1667–1714.

*Primary Examiner*—Peter Chin

*Attorney, Agent, or Firm*—Daniel B. Reece, IV; Terry B. McDaniel; Richard L. Schmalz

[57] ABSTRACT

The invention relates to an improvement in the art of making high pressure laminated materials utilizing saturating kraft paper. In particular, the invention relates to a method for making laminated materials which greatly reduces pressure mark defects caused by fuzz balls.

9 Claims, No Drawings

METHOD FOR PRODUCING HIGH PRESSURE LAMINATES

This application is a continuation-in-part of our commonly assigned, U.S. patent application Ser. No. 08/052,456 filed Apr. 26, 1993, entitled "A Method For Reducing Fuzz In The Production Of Saturating Kraft Paper"; which is a continuation-in-part of our commonly assigned, U.S. patent application Ser. No. 07/887,697 filed May 22, 1992, now both abandoned.

FIELD OF INVENTION

The invention relates to an improvement in the art of making high pressure laminated materials utilizing saturating kraft paper. In particular, the invention relates to a method for making laminated materials which greatly reduces pressure mark defects caused by fuzz balls.

BACKGROUND OF THE INVENTION

High pressure laminates, either decorative or industrial, are composite materials—tough cellulose fibers embedded in a matrix of brittle resin. The resulting material possesses properties different and frequently better than either component. High pressure laminates, for example, possess considerably more flexibility than the cured resin and more water resistance than the fiber.

Westvaco Corporation is a major supplier of resin saturable paper (also known as saturating kraft paper) for laminate formation. This conventional resin saturable paper is formed from a blend of hardwood pulp fibers and softwood (pine) pulp fibers, each of which type fibers are liberated from wood chip via the kraft pulping process. Prior to resin saturable paper formation, the pulps are subjected to low consistency (approximately 3%) refining.

The resin saturable paper is immersed in a bath of resin solution, and excess resin is removed from the surface of the web by squeeze rolls or scraper bars. The sheet is passed through an oven to evaporate the solvent in the resin to a level of 6–8% volatiles. The web is then cooled and either wound in rolls or sheeted to size. Resin-treated sheets are laid up to the desired number of plies and then consolidated under heat (ca. 300° F.) and pressure (ca. 1000 psi). During this operation the resin flows sufficiently to displace air between the plies. Simultaneously the resin polymerizes into a rigid solid. The result is a monolithic structure, the finished composite.

To perform satisfactorily in this service, a saturable paper must possess a special combination of carefully-controlled properties. First of all, the basis weight must be controlled within tight specifications. Not only must it be controlled across and throughout a roll, it must also be controlled on a quarter-inch to two-inch scale. This latter property is generally referred to as formation and is judged by the show-through of light through the sheet. In this case, thin places transmit more light than the heavier weight regions. For a good saturable paper, this formation or show-through should be of low contrast with little difference in light transmission from the darkest to the lightest places.

Good saturable sheets are also relatively clean without sizeable shives or unfiberized pieces of wood. Such material constitutes non-uniformities in the structure causing surface roughness and points of stress concentration. This material is not readily impregnated with resin and thus can become the site of blister initiation.

The most important properties of saturable papers, however, are those that control the rate of resin imbibition and its distribution throughout the sheet. These two distinct physical processes take place simultaneously and consecutively. Both processes are essential to the manufacture of satisfactory composites.

The first process is called saturation. It involves the pickup of resin by the porous structure of the web. It begins when the web enters the resin bath and ends when the scraper bars or other devices remove the excess resin. This process determines the ratio of resin to fiber in the final structure. In general, sufficient resin must be used so that all voids in the product are filled. At the same time, resin is more expensive than paper, so economics dictate against the use of excess resin. Finished laminate properties also begin to suffer if excessive quantities of resin are used.

In general the saturation of the paper is controlled by the pore structure of the paper, the viscosity and surface tension of the resin, and the time required to travel from entering the resin bath to the scraper bars. In practice, the major control is the structure of the paper. This must be tailored to the rest of the operation so resin pickup will be at the desired value. Resin properties and speed are fine-tuning controls.

Once the proper amount of resin has been incorporated into the web, the next concern is achieving uniform and complete distribution of the resin throughout the web. This involves the second of these two distinct physical processes—penetration. It, too, is extremely dependent on the structure of the web. Capillary forces in the pores of the sheet act on the resin solution to redistribute the resin. Fine pores will steal resin from the large pores. The total amount of resin in the sheet becomes an important variable since this determines the quantity of resin to be shared by the various sized pores. In practice, an excess of resin is used to be sure there are no voids where the resin has not reached. As pointed out above, this excess is uneconomic and therefore should be minimized.

Studies of the pore size distribution of paper used in high pressure laminate manufacture indicate this is an important variable. The effects on saturation and penetration, however, are quite different. Saturation is a short time process—on the order of a second. It involves the time between applying the resin and the removal of the excess. During this short interval, most of the resin is picked up in the larger diameter pores, i.e., those 10 micrometers and above in diameter. The smaller ones are also picking up resin but the dynamics favor the larger pores. To enhance saturation, large pores are needed.

Penetration, on the other hand, is a longer term process which starts with the initial contact with the resin and probably does not come to a halt until the resin is completely polymerized in the press. During penetration, the smaller pores or capillaries are stealing resin from the larger pores. It is this process that spreads the resin from the surfaces that contact the resin to the interior of the sheet. Without good penetration, white centers are observed in the saturated sheet. This white is dry fiber which has not been wetted with resin. In general, penetration is enhanced by any process that increases the proportion of pore volume that exists in the smaller pores. This obviously tends to reduce saturation so, in practice, a balance must be maintained. As mentioned earlier, excess resin is used to insure excellent penetration, otherwise voids occur which reduce strength and water resistance and which may become loci for blister formation.

Paper is a network of crossing fibers, more or less bonded to each other. Loose ends from some of these fibers project above the surface of the paper. As the paper proceeds through different machinery some of these fibers are pulled free, producing what is known in the industry as fuzz, dust, or lint.

Saturating kraft is a special type of absorbent paper designed to be impregnated with resin and, therefore, is used primarily for the core stock of laminates. Fuzz released from saturating kraft has traditionally been a major problem for laminate producers. During the production of laminates, saturating kraft paper passes through a phenolic resin bath which makes the paper extremely sticky. Since loose fuzz has a tendency to agglomerate and form fuzz balls, it is common for some of these fuzz balls to collect on and stick to the resin-treated paper. As the paper proceeds through the drying process and becomes cut, sandwiched, and pressed into finished laminates, adhering fuzz balls can cause surface imperfections known as pressure marks. Because pressure-marked laminates are unsuitable for commercial use, these fuzz ball-induced imperfections are an important cause for the rejection of laminates.

Various methods have been tried to address this fuzz problem, including varying the composition and refining level of the paper pulp and vacuuming the paper prior to, and during, laminate production. Although each of these attempts have met with varying degrees of success, pressure marks are still a major problem for the laminate industry.

Therefore, it is the object of this invention to provide an effective and economical method for reducing pressure marks in the production of laminates. Other objects, features, and advantages will be evident from the following disclosures.

SUMMARY OF THE INVENTION

The object of this invention is met by utilizing starch-treated saturated kraft paper to produce high pressure laminates. The application of a dilute starch slurry to the surface of saturating kraft paper greatly reduces the fuzz produced by the paper without adversely affecting the saturation and penetration properties of the paper—necessary properties for laminate production.

DESCRIPTION OF THE PREFERRED EMBODIMENT

An untreated paper surface has two properties which cause liquids to penetrate it. First, there are pores in the paper web which admit the liquid. Second, paper is made of hydrophilic (water-attracting) cellulose fibers. As a result aqueous liquids move into the fiber sheet structure to penetrate the sheet. If one places a drop of water on such a sheet of paper the drop will immediately spread across the surface and swell into the sheet. Thus, it is a common practice in the paper industry to size certain types of paper to increase the paper's resistance to penetration by water and other liquids.

The use of starch as a sizing agent for certain types of paper is well known in the paper industry. In the article "Reduction of Offset Printing Rejects" *TAPPI* November 1967 (pp 135A–137A) Richard F. Burtt reports the results of a study initiated to determine causes of rejection of offset printing grade paper. Among his findings Burtt reported that the addition of certain cooked starches via a size press process to a paper sheet containing about 4–5% moisture facilitated the laying down of the surface fibers of offset printing grade paper.

In U.S. Pat. No. 3,210,240, Read et al. teach a process for surface sizing newsprint, newsroto, novel news, directory, and catalog papers. In this method raw, cooked, or modified starch is dispersed in water via use of a wetting agent and compressed air to form a starch foam. The starch foam is subsequently drained of excess water and applied to the newsprint paper at a rate equivalent to 10 to 20 lbs. per ton of air dried paper.

In U.S. Pat. No. 3,639,209, Buckman et al. teach a process for making paper using cationic starch complexes. The authors disclose reacting aqueous starch with a water-soluble cationic polymeric polyelectrolyte to form a cationic starch complex. This starch complex is subsequently added at the fan pump to the furnish in order to improve the linting characteristics of newsprint paper.

In U.S. Pat. No. 3,859,108, Ware et al. teach the use of a cooked flour size (containing both the protein and the starch fractions of the flour) to seal the surface and/or body of paper or paperboard. This treatment improved the internal fiber bonding and laying of the paper's surface fibers.

In British Patent No. 1,601,282, a method for processing paper fiber webs with starch is disclosed. This method requires the heating of a starch solution almost to gelatinization of the starch particles after application of the solution to the paper.

In Canadian Patent No. 848,397, an apparatus for coating newsprint paper with either hydroxyethylated starch, modified starch, various proteins, melamine formaldehyde, urea formaldehyde, sodium alginate, carboxymethyl cellulose, or carboxyethyl cellulose is described. When used in offset lithographic printing the coated newsprint paper produced less lint than uncoated newsprint paper.

The method taught herein requires the application of a dilute starch slurry to the surface of saturating kraft paper prior to the paper being used to produce laminates. It was a widely held belief in the paper industry that applying starch in this manner to saturating kraft paper would seal the pores and reduce the capillary action of the paper, thereby making the paper unsuitable for use in producing laminates. However, the method taught herein solves that problem by improving bonding on the surface of the sheet without making the sheet repellant to liquids.

In our method starch is mixed with water to form a slurry. The desired starch concentration of the slurry will vary depending on the location and method of application to the paper.

Suitable methods for applying the starch slurry to the surface of the saturating kraft include using showers, size presses, and water boxes. For paper manufactured utilizing a traditional Fourdrinier paper making process the top (or felt) surface of paper is the source of most fuzz, while the bottom (or wire) surface generates relatively little fuzz. Thus, under these conditions it is preferred to apply the starch slurry only to the top (or felt) surface of the paper. However, the starch slurry may be applied to both surfaces of the paper if desired. The starch may be applied during the production of the saturating kraft paper or in a separate application to the produced paper. Size presses may be utilized if the starch is to be applied during the paper's drying cycle, while water boxes are used in conjunction with calendering the paper. The preferred method of application is to use a shower while the paper is still on the Fourdrinier. It is further preferred to apply the starch via a fine spray or misting shower immediately after the dry line on the paper. Each application method lightly covers the saturating kraft with the dilute starch slurry. When the spray treated paper is subsequently subjected to an iodine test, the starch application appears as mottled spotting on the face of the paper.

Either totally cooked, partially cooked, or uncooked starch may be used in this invention. However, when either partially cooked or uncooked starch is utilized it is necessary to provide proper conditions for subsequent cooking of the starch. In the dryer section the combination of high temperatures and moisture cooks the starch particles causing the particles to expand, form a film, and become tacky—thereby bonding loose paper fibers to the sheet.

Of course, the temperature of the dryer section must be high enough to cook the starch, and the required minimum temperature will vary according to the type of starch employed. Suitable starches for use in this invention include any of the conventional commercially available starches such as those derived from corn, wheat, potato, tapioca, waxy maize, sago, rice, sorghum, and arrowroot.

In applying the starch to the paper a suitable application rate for the starch is in the range of about 0.01 to 1.04 pounds of dry starch per 1,000 square feet of saturating kraft produced. Where the saturating kraft has a basis weight of 156 pounds (lbs.), the above-noted starch application rate is equivalent to a range of about 0.4 to 40.0 pounds of dry starch per ton of paper produced. (Of course, the starch application rate when measured in pounds of dry starch per ton of saturated kraft produced will vary according to the basis weight of the paper.) It has been found that starch application rates above about 40.0 lbs/ton results in sticking to the paper machine rolls and thereby leading to excessive paper breaks. The preferred application rate is about 0.13 to 0.21 lb/1,000 $ft^2$ or about 5.0 to 8.0 lbs/ton. While it is extremely difficult to measure, it is estimated that approximately 80–90% of the applied starch is actually retained by the paper. It is well within the ability of a skilled artisan to calculate the pumping rate and starch slurry concentration necessary to apply a desired amount of starch to saturating kraft via a particular method of application.

A number of production methods for manufacturing high pressure laminates are well known in the industry. The improvement taught herein may be utilized with any laminate production method which utilizes saturated kraft paper.

The following examples are provided to further illustrate the present invention and are not to be construed as limiting the invention in any manner.

EXAMPLE 1

A spray application of uncooked starch was applied on a Beloit Paper Machine producing 156 lb. saturating kraft paper. (This and the following examples utilize 156 lb. saturating kraft paper due to the fact that this weight paper is commonly used by industry to produce laminates. However, the procedures described herein work equally well with saturating kraft paper of other weights.) A 10% starch slurry was prepared by mixing 10 parts by weight of B-200 (an unmodified corn starch manufactured by Grain Processing Corporation) with 90 parts by weight of water at ambient temperatures until a slurry had formed. The uncooked starch slurry was applied to the top side of the paper sheet on the Fourdrinier at a position about 3 feet after the dry line using a hand held spray nozzle at a rate of about 3 gallons per minute. The nozzle covered approximately 30 inches of the paper and was positioned in an edge roll position of the sheet. The starch application was calculated to be approximately 1.0 pound of starch per 1000 square feet of paper. The temperature of the dryer section of the machine was measured to be about 150° C. The produced paper was subsequently rewound on a Black Clawson salvage rewinder.

The paper on both the paper machine and on the salvage rewinder was subjected to fuzz testing. A weighed piece of material was contacted with the surface of the paper for the amount of time required for 1,000 feet of the paper to pass under the material. The material was subsequently weighed and tared to ascertain the amount of fuzz collected. The results from the tests are listed in Table I below.

TABLE I

Fuzz Test Results of Starch-Coated Sheet Produced on a Beloit Paper Machine

| | |
|---|---|
| Fuzz Test On Machine (g/1,000 $ft^2$) | |
| Before starch (control) | 0.16 |
| During starch application | 0.04 |
| After starch (control) | 0.24 |
| Fuzz Test on Salvage Rewinder (g/1,000 $ft^2$) | |
| Starch-treated | 0.07 |
| Untreated (control) | 0.28 |
| Untreated (control) | 0.36 |

As the results indicate, the starch-treated sheets produced significantly lower amounts of fuzz than the untreated, control sheets. Saturation and penetration analysis performed on the starch-coated paper showed that the treated paper had properties comparable to those of the unstarched paper. The starch-treated paper did appear somewhat splotchy compared to the untreated paper. (However, after resin treatment the starch-treated paper looked the same as the resinate-treated control paper.)

Laminates were made for evaluation purposes from both the starch-treated paper and the standard 156 lb. saturating kraft (control) paper via the following procedure. First, the paper was cut into a series of 1 foot by 1 foot squares. These paper squares were dipped into a bath of GP-4129 (a phenolic resin compound manufactured by Georgia-Pacific, Inc.) for a time sufficient to permit resin saturation of the paper in the range of about 24–28% by weight of the paper (about one minute). Subsequently, the dipped squares were placed in an explosion proof oven at a temperature of about 150° C. for a time sufficient to attain a volatile (moisture) range of about 7% in the squares (about one minute).

Laminate sandwiches were made by placing a release sheet or square on the bottom, three of the above-treated squares in the middle, and a decorative layer of melamine resin-impregnated paper (manufactured by Mead, Inc.) on the top. Thermowells were inserted in the outer and middle plates in order to monitor temperatures.

The laminate sandwiches were subsequently placed into a hydraulic laminate press and subjected to about 1,200 pounds per square inch of pressure. The temperatures of the laminates were maintained in the range of 100°–250° F. for about 23 minutes; then increased to a range of 260°–280° F. for about 17 minutes. At that time the heating was terminated and the laminates were allowed to cool down for about 16 minutes before the pressure was released and the laminates removed from the press.

The starch-treated laminates were visually examined for pressure mark surface imperfections. No pressure marks were found.

Standard industry blister time and boil test evaluations were conducted on the starch-treated laminates to determine how they compared to laminates produced from the equivalent, untreated paper. The blister times give an indication of the heat resistance of the laminate, while the boil test evaluates how much water absorption can be expected from the laminate.

The blister tests were conducted by placing 3 inch (machine direction) by 9 inch (cross direction) laminate samples (decorative side down) across a 130 volt radiant heater which had been preheated to 375° F. The time required for the laminate to blister (i.e., make a popping sound) was measured. The results are shown in Table II below.

TABLE II

Blister Time Results of Laminates Made from Starch-Treated Saturated Kraft

| | Blister times (sec) at 375° F. | | | |
|---|---|---|---|---|
| Run | 1 | 2 | 3 | 4 |
| Laminate Type: | General Purpose | | Postforming | |
| Untreated Paper | 76.9 | 77.6 | 68.0 | 68.0 |
| Treated Paper | 66.5 | 61.4 | 66.0 | 59.0 |

The results in Table II indicate that the blister times for the starch-treated laminates were slightly lower than those for the laminates made from the untreated paper. However, the starch-treated laminates' blister times were still well within the range considered acceptable by the laminate industry.

The percent swell and the water content of laminates made with the starch-treated paper and with control paper were measured by boil tests. These tests were conducted by first weighing a series of 1 inch (cross direction) by 3 inch (machine direction) laminate samples. The samples were subsequently reweighed after being oven dried at 50° C. for 12 hours. The percent weight loss was calculated and the dry thickness measured using a caliper. At this time the samples were boiled in water for 2 hours before being withdrawn. Any excess moisture was removed from the samples using cheese cloth. The wet samples were weighed and their thicknesses measured using a caliper. The results are listed in Table III below.

TABLE III

Boil Test Results of Laminates from Starch-Treated Saturated Kraft

| | | % Swell Thickness | Average % Water |
|---|---|---|---|
| 1 | untreated paper | 12.20 | 9.81 |
| | starch-treated | 9.76 | 8.72 |
| 2 | untreated paper | 8.54 | 7.66 |
| | starch-treated | 5.95 | 7.30 |

The results show that the percent swell is slightly lower for laminates made with starch-treated paper when compared to laminates made with untreated paper produced on a similar manufacturing run. This is a favorable property indicating that laminates made with starch-treated paper are somewhat more stable to humidity and water than their untreated counterparts.

EXAMPLE 2

A series of cooked starch applications was applied to a roll of 156 lb. saturating kraft paper via the use of a size press equipped with a metered film applicator (a pilot coater). Two types of starch—low-viscosity (L) starch and a low/medium-viscosity (M) starch—were used in the applications. The L starch was processed by cooking in a jet-cooker a 25% solids mixture of oxidized corn starch (manufactured by the Grain Processing Corporation) and water to gell the mixture. The M starch was processed by cooking in a jet-cooker a 25% solids mixture of medium-low viscosity hydroxyethylated corn starch (manufactured by PenFord Products, Inc.) and water to gell the mixture. Both the L starch and the M starch were diluted and applied to the kraft paper at a 6% concentration and a 2% concentration. The respective starch slurries were applied at different rates (see Table IV) to the saturating kraft paper using both a flooded size press and a metered size press.

Each starch solution was applied to the felt side of the sheet before the paper entered (felt side up) an oven heated to 500° F. for drying. After drying, the papers were subjected to a fuzz test (as described in Example 1 above). The papers were further treated with phenolic resin and subjected to standard saturation and penetration tests. Untreated 156 lb. saturating kraft paper was utilized as a control in the tests. The results are listed in Table IV below.

TABLE IV

| Size | Starch | | | | | |
|---|---|---|---|---|---|---|
| Press[1] | Type | Conc. | App.[2] | Fuzz[3] | Sat.[4] | Pene.[5] |
| M | L | 6% | 0.4 | 0.00 | 27.0 | Equal |
| M | L | 2% | 0.2 | 0.03 | 29.9 | More |
| M | M | 2% | 0.2 | 0.04 | 30.3 | More |
| M | M | 6% | 0.3 | 0.01 | 28.8 | Equal |
| F | L | 6% | 1.0 | 0.11 | 19.6 | Less |
| F | L | 2% | 0.5 | 0.08 | 22.1 | Less |
| F | M | 6% | 0.9 | 0.05 | 19.7 | Less |
| F | M | 2% | 0.4 | 0.06 | 24.0 | Less |
| Untreated sheet | | — | — | 0.31 | 28.0 | — |

[1]Method of starch application: M = Metered size press F = Flooded size press
[2]Application Rate: Measured in pounds of starch per 1,000 square feet of paper.
[3]Fuzz Test: The amount of fuzz (in grams) generated by 1,000 square feet of paper.
[4]Saturation Test: The percentage of the phenolic resin absorbed by the paper.
[5]Penetration test: A comparison of how well the resin has distributed through the thickness of the paper using untreated paper as the standard.

As the results indicate, the amounts of fuzz generated decreased significantly after each starch application. Also, the saturation and penetration results from the papers treated with a metered application were comparable to the untreated sheet. Saturability decreased at higher application levels associated with the flooded nip application.

Further evaluations were run to ascertain the amounts of starch to be found on the papers. The results are shown in Table V below.

TABLE V

TABLE V

Analysis of Starch-Coated Paper

| Size | Starch | | |
|---|---|---|---|
| Press | Type | Conc. | Pick-up (lb/1000 $Ft^2$) |
| M | L | 6% | 0.4 |
| M | L | 2% | 0.2 |
| M | M | 2% | 0.2 |
| M | M | 6% | 0.3 |
| F | L | 6% | 1.0 |
| F | L | 2% | 0.5 |
| F | M | 6% | 0.9 |

TABLE V-continued

| Size Press | Analysis of Starch-Coated Paper: Starch Type | Conc. | Pick-up (lb/1000 Ft$^2$) |
|---|---|---|---|
| F | M | 2% | 0.4 |

Decorative laminates were made from the cooked starch-treated paper and the unstarched paper via a conventional commercial process. The saturated kraft sheets were treated in a phenolic resin treater and oven-cured. The cured sheets were subsequently layered with a decorative sheet on the outside and pressed in a high temperature and pressure press to produce the final laminate.

No pressure marks were found on the laminates produced from the cooked starch-treated papers. The blister time and boil test evaluations performed on the laminates indicated that the cooked starch-treated laminates were comparable to the unstarched paper laminates.

EXAMPLE 3

An uncooked starch application was applied to a roll of 156 lb. saturating kraft paper using a size press equipped with a metered film applicator (a pilot coater). Three different conditions were produced and monitored. Condition 1 was a control condition consisting of running the paper through the machine without any applications and with the oven turned off. In Condition 2 there was no treatment of the paper, but the oven was turned on and maintained at a temperature of 500° F. This condition was observed to ascertain if either the oven could be blowing loose fibers off the paper or whether the higher temperature of the paper could be affecting the fuzz tests. In Condition 3 a 2% starch solution was prepared (using the method taught in Example 1) and applied to the top side surface of the paper via the metered size press at an application rate of about 0.08 lb/1,000 ft$^2$ and dried in the oven at a temperature of 500° F.

At least two fuzz tests were run per each condition on the top side of the paper as it exited the oven of the pilot coater. These fuzz test results are shown in Table VI below.

TABLE VI

| Condition[1] | Fuzz Evaluations: Fuzz[2] | Avg Fuzz[2] |
|---|---|---|
| 1 | 0.19 | 0.22 |
| | 0.23 | |
| | 0.25 | |
| 2 | 0.22 | 0.22 |
| | 0.22 | |
| 3 | 0.04 | 0.05 |
| | 0.05 | |

[1]1 = Control with no oven. 2 = Control with oven. 3 = Starch-treated paper.
[2]g/1,000 ft$^2$ The fuzz tests of control Conditions 1 and 2 are the same indicating that neither the heat nor the air circulation from the oven affected the results. The starch-treated papers of Condition 3 gave clearly superior fuzz test results.

The above papers were subsequently evaluated via the use of a pilot treater. Each condition was run at two different speeds. A condition was first run on at the speed necessary to attain the resin pickup required for standard laminates, which was in the 40 to 50 feet per minute (fpm) range. Enough paper was treated at this speed so that several laminates could be produced via the method described in Example 1. Table VII shows the resin pickup (absorption) observed for the three conditions. The most important result seen in Table VII is that of Condition 3 (corresponding to the starch-treated paper), which picked up resin in the same manner as the control conditions.

TABLE VII

| Condition | Resin Pickup of Starch Trial Conditions: Treater Speed (fpm) | % Resin Pickup |
|---|---|---|
| 1 | 40 | 27 |
| | 30 | |
| 2 | 41 | 29 |
| 3 | 40 | 30 |

[1]1 = Control with no oven. 2 = Control with oven. 3 = Starch-treated paper.

After enough paper was treated at standard conditions to make the required laminates, the speed of the treater was increased to 100 fpm for the fuzz testing. The scraper bar was cleaned and each trial condition paper was run at this speed for 25 minutes. The scraper bar was subsequently observed for fuzz buildup. From visual observation, a light-to-medium fuzz accumulated on control Conditions 1 and 2 (no distinction in the amount of fuzz between the conditions), but no fuzz accumulated on the starch condition, Condition 3 (See Table VII).

The results of the fuzz tests on the three conditions are also given in Table VIII. Control Conditions 1 and 2 with no treatment had fuzz test values of 0.23 g/1,000 ft$^2$ and 0.17 g/1,000 ft$^2$ respectively The condition with the starch treatment had a fuzz test value of 0.07 g/1,000 ft$^2$.

TABLE VIII

| Condition | Fuzz Evaluations on Pilot Treater: Fuzz (g/1000 ft$^2$) | Avg Fuzz (g/1000 ft$^2$) | Visual Evaluation |
|---|---|---|---|
| 1 | 0.22 | 0.23 | Medium fuzz |
| | 0.27 | | |
| | 0.18 | | |
| 2 | 0.19 | 0.17 | Medium fuzz |
| | 0.16 | | |
| | 0.16 | | |
| 3 | 0.04 | 0.07 | No fuzz |
| | 0.08 | | |
| | 0.08 | | |

[1]1 = Control with no oven. 2 = Control with oven. 3 = Starch-treated paper.

Using the method described in Example 1, laminates were produced from these trial papers, examined for pressure marks, and subjected to the standard blister time and boil test evaluations. No pressure marks were found on the laminates produced from the starch-treated papers. The results from the blister and boil tests indicated that there is no noticeable difference between the laminates made from starch-treated paper and those made from the other two (untreated) conditions.

EXAMPLE 4

A series of uncooked starch applications were conducted on a Beloit Paper Machine. A nozzled shower emitting a 36-inch-wide misting shower was manually held over the moving paper at different positions. One of the five nozzles of the shower was plugged so that only a side roll of 36 inches was sprayed. About 2 gallons per minute of the various starch solutions were sprayed on top of the 36-inch side roll. The starch solutions were produced by following the method described in Example 2. The paper was sprayed at different positions (i.e., about a foot after the dry line and about a foot before the dry line) at different starch application rates.

The starch application was controlled by using starch solutions of different concentrations. The temperature of the dryer section of the machine was about 150° C.

The first three conditions listed in Table IX were run for approximately 10 minutes each with control paper (unsprayed) being produced between conditions. Condition 4 had been running for two-to-three minutes when a break occurred on the paper machine. The break most probably occurred because starch buildup on the second press roll caused the paper to stick to the roll. Condition 4 was a very high starch application.

TABLE IX

| | | Starch Trial Conditions | | |
|---|---|---|---|---|
| | | Starch Application | | Starch |
| Condition | Shower Location | (lb/1000 ft$^2$) | (lb/ton) | Concentration (lb starch/55 gal.) |
| 1 | After dry line | 0.13 | 5 | 9 (2%) |
| 2 | Before dry line | 0.33 | 13 | 23 (5%) |
| 3 | After dry line | 0.7 | 27 | 48 (11%) |
| 4 | Before dry line | 1.0 | 38 | 68 (15%) |

Fuzz tests were performed on the machine for each starch condition and the control condition. Fuzz tests were later conducted on a Black Clawson salvage rewinder, and a fuzz evaluation using a commercial laboratory instrument (LI) was also conducted on samples of the final paper. The results of these evaluations, reported in Table X, are the averages of at least two tests.

Table X also describes the appearance of the paper. The paper from Conditions 1 and 2 looked like the control paper. The paper from Condition 3 looked splotchy and the paper from Condition 4 was very splotchy. When the paper from all conditions was sprayed with iodine, the spray pattern where the starch actually hit the paper was readily apparent.

TABLE X

| | | | Fuzz Test Results | | | |
|---|---|---|---|---|---|---|
| | Shower | Starch | Fuzz (g/1000 ft$^2$) | | | Paper |
| Condition | Location | lb/1000 ft$^2$ | Machine | Sal. Rew. | LI Fuzz (mg) | Appearance |
| Control | | No starch | 0.13 | 0.46 | 38 | |
| 1 | * | 0.13 | 0.03 | 0.09 | 12 | Like control |
| 2 | ** | 0.33 | 0.03 | 0.02 | 3 | Like control |
| 3 | * | 0.7 | 0.01 | 0.01 | 2 | Splotchy |
| 4 | ** | 1.0 | 0.02 | 0.09 | 2 | Very splotchy |

*After dry line
**Before dry line

Laminates were made via the procedure described in Example 1 with the control paper and paper from Conditions 1, 2, and 3. Table XI lists the saturation results, the blister times of the laminates, and the percent swell results from boil tests. Paper from the three starch conditions picked up the same amount of resin as the control paper. The blister times of the laminates were all within specifications (but they may be dropping slightly with additional starch usage). The percent swell of the laminates resulting from the boil test was the same for the three starch conditions as for the control.

TABLE XI

| | Laminates Resulting from Starch Sprayed Paper | | | | | |
|---|---|---|---|---|---|---|
| Condition | Shower Location | lb/ 1000 ft$^2$ | Control | Resin Pickup (%) | Blister Time (sec) | % Swell |
| Control | | No starch | | 27 | 65 | 20 |
| 1 | After dry line | 0.13 | 1 | 27 | 66 | 20 |
| 2 | Before dry line | 0.33 | 2 | 27 | 60 | 20 |
| 3 | After dry line | 0.7 | 3 | 27 | 56 | 20 |

EXAMPLE 5

A series of uncooked starch spray applications to saturating kraft paper were conducted to evaluate the effect of four process variables. The four variables investigated were:

1) the application rate for starch sprayed on the paper (2.5 lb/ton v 6.0 lb/ton),
2) the mixing conditions of the starch solution (mild v robust),
3) the height of the shower, and
4) the angle of the shower impingement on the paper (straight down upon the paper v a 45° angle).

The evaluation consisted of an eight-run screening design with the four variables under investigation. The starch applications were applied over an edge roll position about one foot past the dry line via a misting shower during a 156 lb. saturating kraft run on a Beloit Paper Machine with the dryers set at a temperature of 150° C.

The low and high values of the four variables are listed in Table XII below.

TABLE XII

| | Variable Assignment for Example 5 | | | |
|---|---|---|---|---|
| Run | Starch App. Rate (lbs/ton) | Mixing Cond.[a] | Shower Height (inches) | Shower Angle (degrees) |
| 1 | 6.0 | high | 6" | 90° |
| 2 | 6.0 | high | 10" | 45° |
| 3 | 2.5 | high | 10" | 90° |
| 4 | 2.5 | high | 6" | 45° |
| 5 | 6.0 | low | 6" | 45° |
| 6 | 6.0 | low | 10" | 90° |
| 7 | 2.5 | low | 10" | 45° |
| 8 | 2.5 | low | 6" | 90° |

[a]Mixing Conditions:
Low = Water temperature of 90° F., hand mixed, solution used immediately.
High = Water temperature of 120° F., agitator mixed, solution used after 6 hours storage under agitation.

The variable labeled "mixing condition" refers to the temperature of the water used, the degree of agitation, and the amount of time the starch solution was stored before use. The low-mixing condition used water at ambient temperature (about 90° F.), low agitation with a paddle, and the starch solution was used immediately. Under the high-mixing condition, the water was at 120° F., the solution was agitated with a Lightnin Mixer, and the starch was stored under agitation for approximately six hours before use.

The "shower height" variable refers to the height of the shower nozzle above the paper. In both cases, the overlap between nozzles was constant.

Table XIII below lists the trial conditions in the order that they were run along with the fuzz testing results.

TABLE XIII

| | | | Fuzz Results | | | | |
|---|---|---|---|---|---|---|---|
| | | | | | Fuzz (g/1000 ft) | | |
| Run | Starch (lb/ton) | Mixing Cond. | Shower Height | Shower Angle° | Mach | Sal Rew | LI (mg) |
| 2 | no starch | | | | 0.05 | 0.21 | 32 |
| 1 | 6.0 | high | 6" | 90° | 0.01 | 0.10 | 8 |
| 2 | 6.0 | high | 10" | 45° | 0.00 | 0.08 | 9 |
| 3 | 2.5 | high | 10" | 90° | 0.02 | 0.14 | 13 |
| 4 | 2.5 | high | 6" | 45° | 0.02 | 0.14 | 13 |
| 5 | 6.0 | low | 6" | 45° | 0.01 | 0.13 | 7 |
| 6 | 6.0 | low | 10" | 90° | 0.03 | 0.09 | 7 |
| 7 | 2.5 | low | 10" | 45° | 0.04 | 0.15 | 11 |
| 8 | 2.5 | low | 6" | 90° | 0.02 | 0.17 | 12 |

[1]Mixing Conditions:
Low = Water temperature of 90° F., hand mixed, solution used immediately.
High = Water temperature of 120° F., agitator mixed, solution used after 6 hours storage under agitation.
[2]Control: untreated 156 lb. saturating kraft paper.

The results of the fuzz test shown above are the average of several measurements. Fuzz evaluations (fuzz) were conducted by the fuzz test described in Example 1 for both the paper as produced from the Beloit Paper Machine and the produced paper subsequently run through a Black Clawson salvage rewinder. The produced paper was also evaluated for fuzz using a commercial laboratory instrument (LI).

The data listed in Table XIII above clearly indicate that all of the trial conditions were successful in reducing fuzz. The data also show that the amount of starch sprayed on the sheet is the only variable of the four tested that had an effect on the fuzz reduction of saturating kraft during starch spray trials. A 2.5 lb/ton starch application was slightly less effective than a 6.0 lb/ton starch application in reducing fuzz. However, the fuzz reduction measured was still significant (reduction of more than half according to the LI values) at the 2.5 lb/ton starch application level.

Laminates were made from the untreated control paper and both the 2.5 lb/ton and the 6.0 lb/ton starch-containing paper produced in this trial via the methods described in both Example 1 and Example 2. The laminates were examined for pressure marks, and subjected to the standard blister time and boil test evaluations. No pressure marks were found on the laminates produced by either method using either of the starch-treated papers. Although the blister times of the laminates made from the starch-treated papers were somewhat lower than those of laminates made from the control paper, they were still well within usable specifications. The boil test results indicated no substantial differences between the laminates made from starch-treated papers and those made from the untreated control paper.

Many modifications and variations of the present invention will be apparent to one of ordinary skill in the art in light of the above teaching. It is understood therefore that the scope of the invention is not to be limited by the foregoing description but rather is to be defined by the claims appended hereto.

What is claimed is:

1. A method for the production of high pressure laminates wherein the improvement comprises resin-impregnating starch-treated saturating kraft paper, said paper being produced by forming a sheet on a Fourdrinier wire cloth from an aqueous fluid containing cellulosic pulp and other papermaking ingredients, and applying to the surface of the sheet a starch slurry, comprised of starch and water, at an application rate in the range of about 0.01 to 1.04 pounds of starch per 1,000 square feet of paper; and applying pressure to the resin-impregnated paper to form the laminates.

2. The method of claim 1 wherein the starch is derived from a member selected from the group consisting of corn, wheat, potato, tapioca, waxy maize, sago, rice, sorghum, and arrowroot.

3. The method of claim 1 wherein the starch is uncooked starch.

4. The method of claim 1 wherein the starch is partially cooked starch.

5. The method of claim 1 wherein the starch is cooked starch.

6. The method of claim 1 wherein the application rate for the starch slurry is in the range of about 0.13 to 0.21 pound of starch per 1,000 square feet of saturating kraft paper.

7. The method of claim 1 wherein the starch slurry is applied by a means selected from a member of the group consisting of size presses, water boxes, and showers.

8. The method of claim 1 wherein the starch slurry is applied to the sheet after dry line.

9. The high pressure laminate product of claim 1.

* * * * *